US009429306B2

(12) United States Patent
Liu et al.

(10) Patent No.: US 9,429,306 B2
(45) Date of Patent: Aug. 30, 2016

(54) DC LED MODULE HAVING BRIDGE RECTIFYING AND FILTERING FUNCTION

(71) Applicant: LUSTROUS TECHNOLOGY LTD., New Taipei (TW)

(72) Inventors: Chia-Chi Liu, New Taipei (TW); Chia-Lung Hsueh, New Taipei (TW); Kao-Hsu Chou, New Taipei (TW)

(73) Assignee: LUSTROUS TECHNOLOGY LTD., New Taipei (TW)

( * ) Notice: Subject to any disclaimer, the term of this patent is extended or adjusted under 35 U.S.C. 154(b) by 122 days.

(21) Appl. No.: 14/585,113

(22) Filed: Dec. 29, 2014

(65) Prior Publication Data

US 2016/0109104 A1 Apr. 21, 2016

(30) Foreign Application Priority Data

Oct. 21, 2014 (TW) ..... 103218612 U

(51) Int. Cl.

| | |
|---|---|
| ***F21V 23/02*** | (2006.01) |
| ***F21V 17/10*** | (2006.01) |
| ***F21V 7/04*** | (2006.01) |
| *F21V 29/89* | (2015.01) |
| *F21Y 101/02* | (2006.01) |

(52) U.S. Cl.

CPC ..... *F21V 23/02* (2013.01); *F21V 17/10* (2013.01); *F21V 7/04* (2013.01); *F21V 7/041* (2013.01); *F21V 17/104* (2013.01); *F21V 29/89* (2015.01); *F21Y 2101/02* (2013.01)

(58) Field of Classification Search

CPC ..... F21V 23/02; F21V 17/10; F21V 29/70; F21V 29/89; F21V 7/04; F21V 7/041; F21Y 2101/02

See application file for complete search history.

(56) References Cited

U.S. PATENT DOCUMENTS

| | | | | |
|---|---|---|---|---|
| 8,212,469 | B2 * | 7/2012 | Rains, Jr. | F21K 9/135 313/503 |
| 8,915,610 | B2 * | 12/2014 | Fujita | F21S 8/02 362/227 |
| 9,028,086 | B2 * | 5/2015 | Woo | F21K 9/30 362/294 |
| 2013/0070464 | A1 * | 3/2013 | Shinohara | F21V 3/00 362/373 |

* cited by examiner

*Primary Examiner* — Alan Cariaso
(74) *Attorney, Agent, or Firm* — Guice Patents PLLC

(57) ABSTRACT

A DC LED module having bridge rectifying and filtering function includes: an insulation seat, formed with a first surface and a second surface, wherein a concave area is formed on the first surface, and an opening and at least one buckle slot are formed at a substantially central portion of the concave area; a reflection cup, formed with at least one buckle structure for being buckled with the at least one buckle slot of the insulation seat; a circuit board, installed with an LED light source, wherein the circuit board is fastened on the second surface of the insulation seat, and the LED light source is aligned with the opening; and a bridge rectifying and filtering member, disposed at the exterior of the insulation seat and electrically coupled to a power input port of the circuit board for providing a DC voltage to the circuit board.

5 Claims, 3 Drawing Sheets

DC LED MODULE HAVING BRIDGE RECTIFYING AND FILTERING FUNCTION

BACKGROUND OF THE INVENTION

1. Field of the Invention

The present invention relates to a direct current light emitting diode module (hereinafter referred as a DC LED module), especially to a DC LED module having bridge rectifying and filtering function.

2. Description of Related Art

A conventional DC LED module is often installed with a rectifying and filtering circuit in a housing for converting an AC voltage into a DC voltage so as to supply electric power to a LED load, wherein the rectifying and filtering circuit includes a bridge rectifier and a filtering capacitor. In addition, for being combined with a reflection cup, one surface of the housing is formed with a reflection cup accommodating concave surface.

However, because the installation of the bridge rectifier and the filtering capacitor would cause the depth of the reflection cup accommodating concave surface of the DC LED module to be increased, so a mechanical interference may be generated between a reflection cup having a larger dimension and the reflection cup accommodating concave surface thereby not allowing the reflection cup to be combined with the DC LED module.

In view of the above-mentioned disadvantages, a novel DC LED module shall be invented.

SUMMARY OF THE INVENTION

One primary objective of the present invention is to provide a DC LED module having bridge rectifying and filtering function, in which a bridge rectifying and filtering member is installed for converting an AC voltage into a DC voltage so as to drive a LED load.

Another objective of the present invention is to provide a DC LED module having bridge rectifying and filtering function, in which a bridge rectifying and filtering member is disposed at the exterior of an insulation seat thereby enabling the insulation seat to be formed in a small thickness, so the small-thickness insulation seat is able to accommodate a reflection cup having various dimensions For achieving said objectives, the present invention provides a DC LED module having bridge rectifying and filtering function, which includes:

- an insulation seat, formed with a first surface and a second surface, wherein a concave area is formed on the first surface, and an opening and at least one buckle slot are formed at a substantially central portion of the concave area;
- a reflection cup, formed with at least one buckle structure for being buckled with the at least one buckle slot of the insulation seat;
- a circuit board, installed with an LED light source, wherein the circuit board is fastened on the second surface of the insulation seat, and the LED light source is aligned with the opening; and
- a bridge rectifying and filtering member, disposed at the exterior of the insulation seat and electrically coupled to a power input port of the circuit board for providing a DC voltage to the circuit board.

According to one embodiment of the present invention, the at least one buckle structure of the reflection cup is buckled with the at least one buckle slot of the insulation seat with a rotating means.

According to one embodiment of the present invention, the bridge rectifying and filtering member includes a bridge diode rectifier circuit and a filtering capacitor.

According to one embodiment of the present invention, the DC LED module having bridge rectifying and filtering function further includes a heat dissipation base which is in contact with one surface of the circuit board.

According to one embodiment of the present invention, the heat dissipation base is made of an aluminum substrate.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
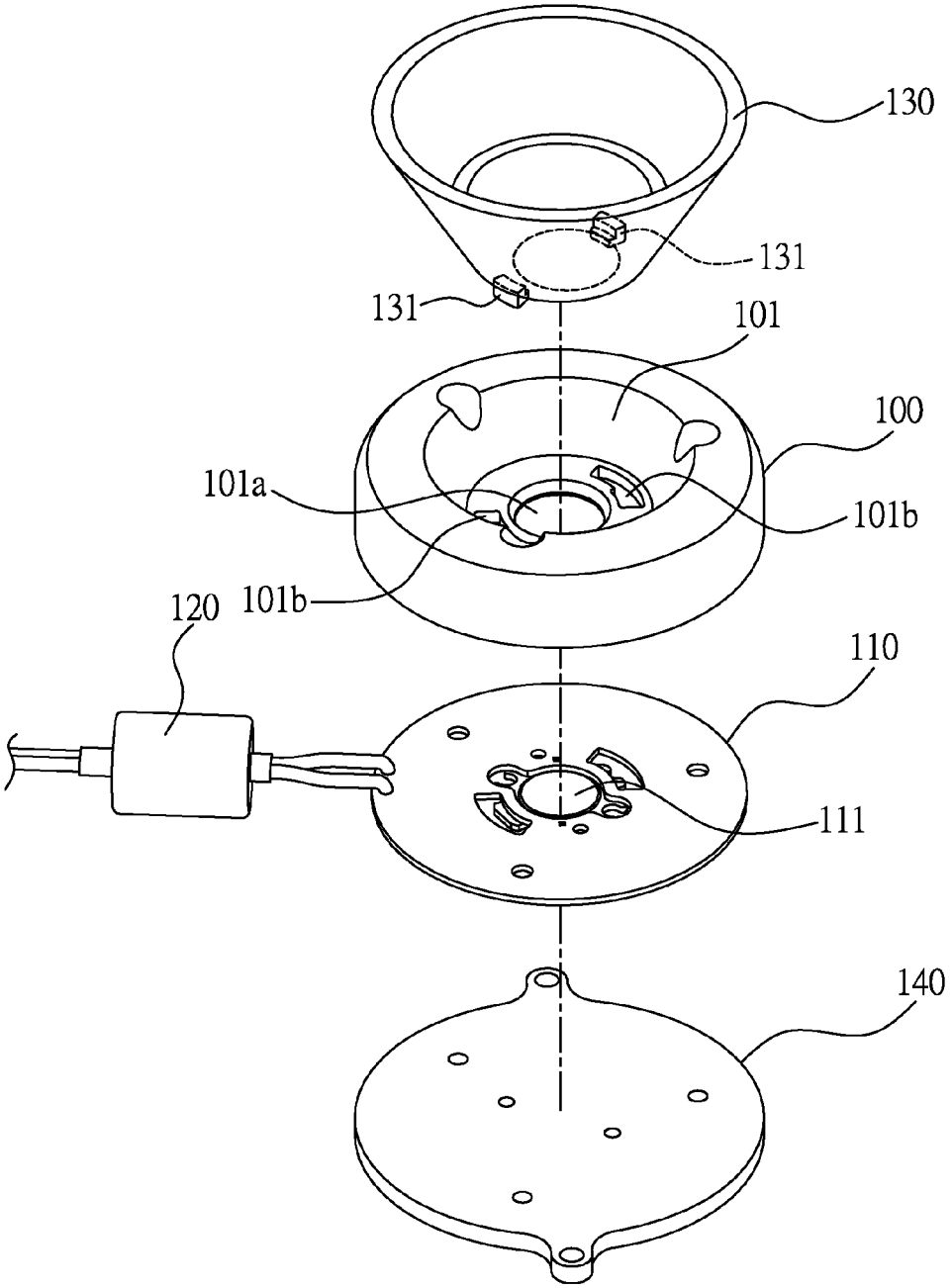
FIG. 1 is an exploded view illustrating a DC LED module having bridge rectifying and filtering function according to one embodiment of the present invention.

Referring to FIG. 1, which is an exploded view illustrating a DC LED module having bridge rectifying and filtering function according to one embodiment of the present invention. As shown in FIG. 1, the DC LED module having bridge rectifying and filtering function includes an insulation seat 100, a circuit board 110, a bridge rectifying and filtering member 120, a reflection cup 130 and a heat dissipation base 140.

The insulation seat 100 is formed with a first surface and a second surface, wherein a concave area 101 is formed on the first surface, and an opening 101*a* and at least one buckle slot 101*b* are formed at a substantially central portion of the concave area 101.

The circuit board 110 is installed with an LED light source 111, wherein the circuit board 110 is fastened on the second surface of the insulation seat 100, and the LED light source 111 is able to be aligned with the opening 101*a* when the circuit board 110 is combined with the insulation seat 100.

The bridge rectifying and filtering member 120 is electrically coupled to a power input port of the circuit board 110 for providing a DC voltage to the circuit board 110. The bridge rectifying and filtering member 120 includes a bridge diode rectifier circuit and a filtering capacitor (not shown in figures), wherein the bridge diode rectifier circuit is served to convert an AC voltage into a full-wave rectifying voltage, and the filtering capacitor is served to filter the AC portion of the full-wave rectifying voltage.

The reflection cup 130 is served to define an illuminating direction and formed with at least one buckle structure 131. The at least one buckle structure 131 is buckle with the at least one buckle slot 101*b* of the insulation seat 100 with a rotating means, thereby enabling the reflection cup 130 to be combined with the insulation seat 100. What shall be addressed is that the opened portion of the reflection cup 130 can be formed in different dimensions.

The heat dissipation base 140 can be made of an aluminum substrate and in contact with one surface of the circuit board 110 for providing a heat dissipation function.

Figure 2:
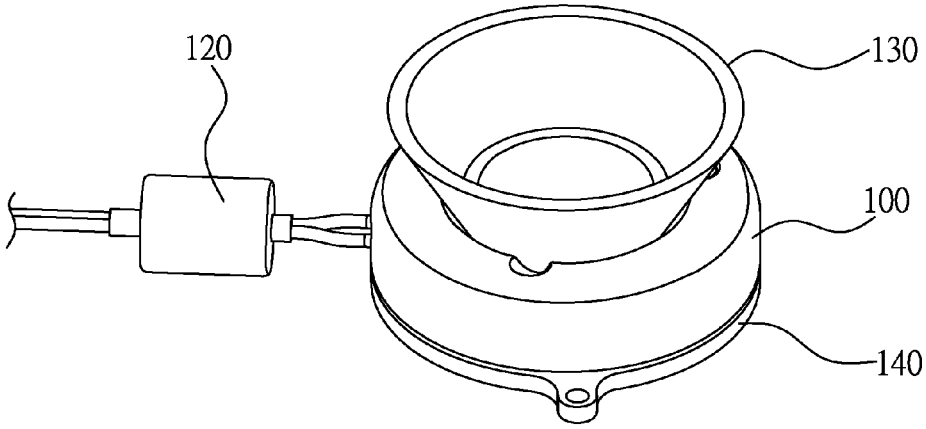
FIG. 2 is a schematic view illustrating the assembly of the DC LED module having bridge rectifying and filtering function according to one embodiment of the present invention.
Figure 3:
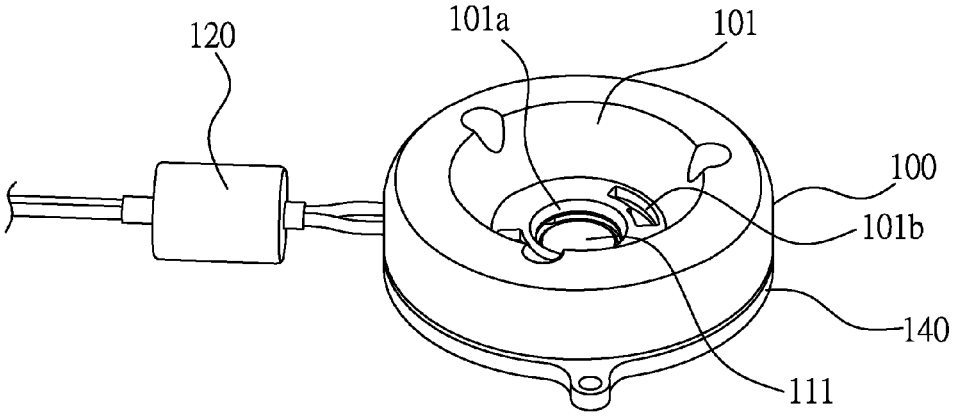
FIG. 3 is a schematic view illustrating the assembly of the DC LED module having bridge rectifying and filtering function of FIG. 2 in which a reflection cup not being combined according to one embodiment of the present invention.
Figure 4A:
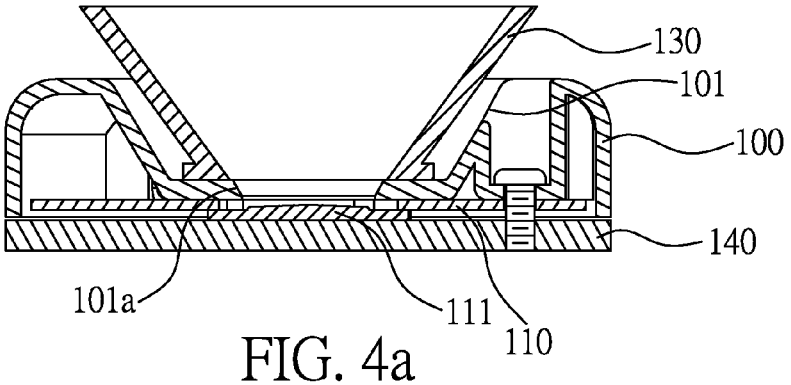
FIG. 4*a* to FIG. 4*c* are cross sectional views illustrating the DC LED module having bridge rectifying and filtering function being respectively combined with a reflection cup having three different dimensions.
Figure 4B:
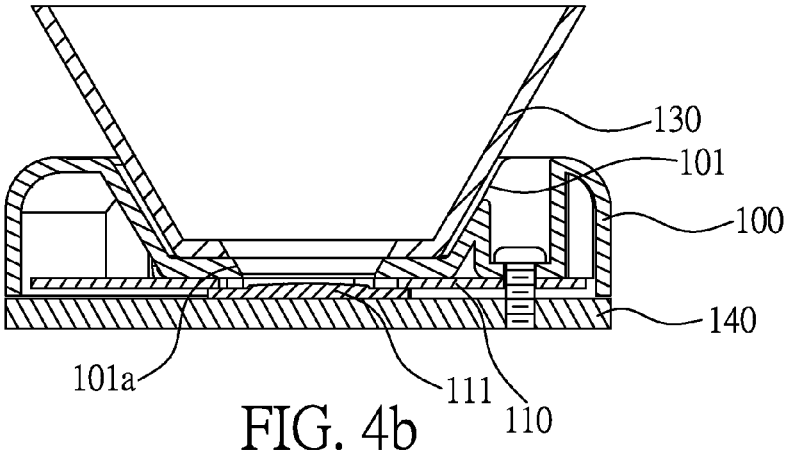
Figure 4C:
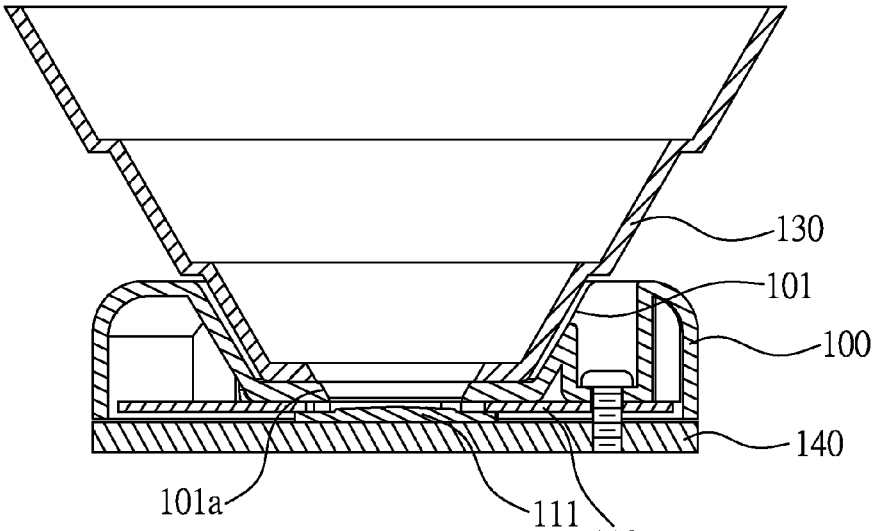

Referring to FIG. 2 and FIG. 3, wherein FIG. 2 is a schematic view illustrating the assembly of the DC LED module having bridge rectifying and filtering function according to one embodiment of the present invention; and FIG. 3 is a schematic view illustrating the assembly of the DC LED module having bridge rectifying and filtering function of FIG. 2 in which a reflection cup not being combined according to one embodiment of the present invention. As shown in FIG. 2, the bridge rectifying and filtering member 120 of the DC LED module having bridge rectifying and filtering function is disposed at the exterior of the insulation seat 100 for converting an AC voltage into a DC voltage. Because the bridge rectifying and filtering member 120 is disposed at the exterior of the insulation seat 100, the height of the above-mentioned concave area 101 of the insulation seat 100 can still be minimized thereby preventing a mechanical interference from being generated between the reflection cup 130 and the above-mentioned concave area 101, so the reflection cup 130 is enabled to be formed in various dimensions and still can be accommodated. Referring from FIG. 4*a* to FIG. 4*c*, which are cross sectional views illustrating the DC LED module having bridge rectifying and filtering function being respectively combined with the reflection cup having three different dimensions.

Based on what has been disclosed above, advantages achieved by the present invention are as followings:

1. The DC LED module having bridge rectifying and filtering function provided by the present invention is installed with the bridge rectifying and filtering member for converting an AC voltage into a DC voltage so as to drive a LED load.
2. The DC LED module having bridge rectifying and filtering function provided by the present invention allows the bridge rectifying and filtering member to be disposed at the exterior of the insulation seat thereby enabling the insulation seat to be formed in a small thickness, so the small-thickness insulation seat is able to accommodate the reflection cup having various dimensions.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A DC LED module having bridge rectifying and filtering function, including:

an insulation seat, formed with a first surface and a second surface, wherein a concave area being formed on said first surface, and an opening and at least one buckle slot being formed at a substantially central portion of the concave area;

a reflection cup, formed with at least one buckle structure for being buckled with said at least one buckle slot of said insulation seat;

a circuit board, installed with an LED light source, wherein said circuit board being fastened on said second surface of said insulation seat, and said LED light source being aligned with said opening; and a bridge rectifying and filtering member, disposed at the exterior of said insulation seat and electrically coupled to a power input port of said circuit board for providing a DC voltage to said circuit board.

2. The DC LED module having bridge rectifying and filtering function as claimed in claim 1, wherein said at least one buckle structure of said reflection cup is buckled with said at least one buckle slot of said insulation seat with a rotating means.

3. The DC LED module having bridge rectifying and filtering function as claimed in claim 1, wherein said bridge rectifying and filtering member includes a bridge diode rectifier circuit and a filtering capacitor.

4. The DC LED module having bridge rectifying and filtering function as claimed in claim 1, further including a heat dissipation base which is in contact with one surface of said circuit board.

5. The DC LED module having bridge rectifying and filtering function as claimed in claim 4, wherein said heat dissipation base is made of an aluminum substrate.

* * * * *